US008307665B2

(12) United States Patent
Nagamune

(10) Patent No.: US 8,307,665 B2
(45) Date of Patent: Nov. 13, 2012

(54) SAMPLE COOLING APPARATUS

(75) Inventor: Yasushi Nagamune, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 1536 days.

(21) Appl. No.: 11/730,896

(22) Filed: Apr. 4, 2007

(65) Prior Publication Data

US 2007/0234751 A1 Oct. 11, 2007

(30) Foreign Application Priority Data

Apr. 6, 2006 (JP) ..... 2006-105586

(51) Int. Cl.
*F25B 9/00* (2006.01)
*F25B 19/00* (2006.01)

(52) U.S. Cl. ..... 62/6; 62/51.1

(58) Field of Classification Search ..... 62/6, 51.1, 62/295; 438/16

See application file for complete search history.

(56) References Cited

U.S. PATENT DOCUMENTS 2,996,772 A * 8/1961 Deacon ..... 52/479
3,648,048 A * 3/1972 Cahan et al. ..... 250/442.11
3,894,403 A * 7/1975 Longsworth ..... 62/51.1
4,097,738 A * 6/1978 Feve et al. ..... 250/305
4,363,217 A * 12/1982 Venuti ..... 62/55.5
4,394,819 A * 7/1983 Averill ..... 62/51.1
4,467,250 A * 8/1984 Thomasson ..... 318/436
5,197,295 A * 3/1993 Pundak ..... 62/6
5,327,733 A * 7/1994 Boolchand et al. ..... 62/51.1
5,363,077 A * 11/1994 Herd et al. ..... 335/216
5,647,219 A * 7/1997 Rattray et al. ..... 62/6
5,704,220 A 1/1998 Yamazaki
5,934,082 A 8/1999 Steinmeyer
5,936,861 A * 8/1999 Jang et al. ..... 700/98
5,966,944 A * 10/1999 Inoue et al. ..... 62/51.1
6,825,466 B2 * 11/2004 Mordekhay ..... 250/288

(Continued)

FOREIGN PATENT DOCUMENTS

JP 61-81580 U 5/1986

(Continued)

OTHER PUBLICATIONS

"Housing | Define Housing at Dictionary.com." Dictionary.com | Find the Meanings and Definitions of Words at Dictionary.com. Web. Oct. 27, 2011. <http://dictionary.reference.com/browse/housing>.*

(Continued)

*Primary Examiner* — Cheryl J Tyler
*Assistant Examiner* — Ignacio E Landeros
(74) *Attorney, Agent, or Firm* — Birch, Stewart, Kolasch & Birch, LLP

(57) ABSTRACT

A sample cooling apparatus capable of cooling and holding samples or wafers at a cryogenic temperature with no vibration or drift with respect to a measurement reference surface is disclosed. In the sample cooling apparatus, a sample holder is arranged in a vacuum vessel mounted on a housing having a table for forming a measurement reference surface to be supported by a thermal insulator. A frame is disposed within the housing to be supported by a first buffer. A refrigerating machine is disposed in the frame to be supported by a second buffer and has a head directed to the vacuum vessel. The cooling head of the refrigerating machine is connected to the sample holder by way of a flexible thermal conduction member.

31 Claims, 9 Drawing Sheets

U.S. PATENT DOCUMENTS

| | | | | |
|---|---|---|---|---|
| 6,853,204 | B2 * | 2/2005 | Nishiyama et al. | 324/750.02 |
| 7,043,848 | B2 * | 5/2006 | Hollman et al. | 33/556 |
| 2005/0126187 | A1 | 6/2005 | Li et al. | |

FOREIGN PATENT DOCUMENTS

| | | | |
|---|---|---|---|
| JP | 01-104349 | A | 4/1989 |
| JP | 5-34557 | U | 5/1993 |
| JP | 5-243042 | A | 9/1993 |
| JP | 5-245395 | A | 9/1993 |
| JP | 5-297092 | A | 11/1993 |
| JP | 6-74819 | A | 3/1994 |
| JP | 6-109821 | A | 4/1994 |
| JP | 7-84058 | A | 3/1995 |
| JP | 9-50910 | A | 2/1997 |
| JP | 9-229997 | A | 9/1997 |
| JP | 11-87131 | A | 3/1999 |
| JP | 11-512512 | A | 10/1999 |
| JP | 2002-277086 | A | 9/2002 |
| JP | 2005-24184 | A | 1/2005 |
| JP | 2006-41259 | A | 2/2006 |
| JP | 2006041259 | A * | 2/2006 |

OTHER PUBLICATIONS

"Buffer | Define Buffer at Dictionary.com." Dictionary.com | Find the Meanings and Definitions of Words at Dictionary.com. Web. Oct. 27, 2011. <http://dictionary.reference.com/browse/buffer>.*

Decision to Grant a Patent (Japanese Application No. 2007-101158; dated Jul. 19, 2011.

* cited by examiner

SAMPLE COOLING APPARATUS

CROSS REFERENCES TO RELATED APPLICATIONS

This application claims the priority benefit of Japanese Patent Application No. 2006-105586 filed on Apr. 6, 2006.

STATEMENT REGARDING FEDERALLY SPONSORED RESEARCH

Not Applicable.

BACKGROUND OF THE INVENTION

1. Field of the Invention

The present invention relates to an apparatus for cooling samples or wafers at a cryogenic temperature so as to perform microscopic observation, microspectroscopic analysis, near-field microscopic observation, near-field spectroscopic analysis, and photoconduction characteristic evaluation, or conduction characteristic evaluation.

2. Description of the Related Art

When samples or wafers are cooled at a cryogenic temperature with a refrigerating machine, a vibration of the refrigerating machine as a vibration source propagates to the samples or wafers. As a result, the samples or wafers vibrate or drift with respect to a measurement reference surface, which deteriorates a precision of microscopic observation, microspectroscopic analysis, near-field microscopic observation, near-field spectroscopic analysis, photoconduction characteristic evaluation, or conduction characteristic evaluation.

Conventionally, a method for connecting a vacuum vessel and a refrigerating machine by way of a vibration reducing adapter has been proposed in order to prevent samples or wafers from vibrating or drifting as disclosed in Japanese Patent laid-open publications No. Tokkaihei 05-243042, No. Tokkaihei 07-84058, No. Tokkaihei 09-50910, No. Tokkaihei 11-87131 and No. Tokkaihei 11-512512. The vibration reducing adapter can decrease the vibration or drift of the samples or wafers. It is still insufficient for an optical measurement in a high spatial resolution. In association with such a method, a method for reducing vibration with a weight attached to the refrigerating machine as disclosed in Japanese Patent laid-open publications No. Tokkaihei 09-229997 and No. Tokkai 2006-41259, and a method for reducing vibration by securely fixing the refrigerating machine on a floor as disclosed in Japanese Patent laid-open publication No. Tokkai 2005-24184 have been proposed. These methods can further reduce vibration or drift of samples or wafers but are insufficient for the optical measurements requiring a high spatial resolution of 1 micrometer or less.

In Japanese Patent laid-open publication No. Tokkai 05-245395, there is proposed a method for nulling a relative motion between a sample and a measurement system by fixing the sample and the measurement system to a vibrating potion of the refrigerating machine. However, the relative motion cannot become zero as a matter of fact, because the vibrating portion of the machine vibrates acceleratingly which makes the measuring system or the member fixed to the measuring system to deform.

Furthermore, a method for cooling a sample with air, helium gas, or liquid helium so as not to propagate vibration of the refrigerating machine directly to the sample is known in the art as disclosed in Japanese Patent laid-open publications No. Tokkaihei 05-297092, No. Tokkaihei 06-74819 and No. Tokkaihei 06-109821. However, the substantial vibration reducing effect is insufficient, because the vibration of the refrigerating machine propagates indirectly via a sample supporting member. A method for stopping the refrigerating machine once during the measurement is known in the art as disclosed in Japanese Patent laid-open publication No. Tokkai 2002-277086. However, this method is unsuitable for the precision measurement, because of unstable temperatures and a large drift of a sample.

SUMMARY OF THE INVENTION

The present invention is made to solve the above-mentioned problems. An object of the present invention is to provide a sample cooling apparatus for eliminating vibration or drift of a single or plural samples or wafers with respect to a measurement reference surface at a time of cooling the single or plural samples or wafers at a cryogenic temperature. Preferably, vibration or drift of the single or plural samples or wafers is limited to 0.2 μm or less at a temperature of 20 K or less so that the single or plural samples or wafers can be accurately evaluated at the cryogenic temperature and with a high spatial resolution.

In order to solve the problems, the present invention provides a sample cooling apparatus which comprises a sample holder arranged in a vacuum vessel to be supported by a thermal insulator. The vacuum vessel is mounted on a housing having a table for forming a measurement reference surface. A frame is disposed within the housing to be supported by a first buffer arranged between the housing and the frame. A refrigerating machine is disposed within the frame to be supported by a second buffer arranged between the frame and the refrigerating machine and having a head of the refrigerating machine directed to the vacuum vessel. The head of the refrigerating machine is connected to the sample holder through a flexible thermal conduction member arranged between the sample holder and the head of the refrigerating machine.

According to the present invention, it is preferable to dispose the vacuum vessel on one side of the measurement reference surface and the frame on the other side. The housing having the table for forming the measurement reference surface is provided with a hole. The vacuum vessel having a U-shaped cross section and an opening at the lower portion thereof is disposed above the hole, and the frame having a U-shaped cross section and an opening at the upper portion thereof is disposed below the hole. The refrigerating machine is disposed in the frame in such a way that the head of the refrigerating machine is directed to the vacuum vessel and a lower portion of the refrigerating machine is positioned in the frame. The frame may have a multistage or dual structure containing at least one inner frame within an outer frame, each of which is independently supported by multiple set of buffer. The refrigerating machine is surrounded by a sealing wall, and an upper portion of the sealing wall and a lower portion of the vacuum vessel are coupled together with a flexible vacuum bellows arranged between the sealing wall and the vacuum vessel. The sample holder, the flexible thermal conduction member, and the head of the refrigerating machine are preferably covered with a thermal radiation shield, which is connected to an intermediate cooling portion of the refrigerating machine. Vibration and drift of a single or plural samples or wafers fixed on the sample holder is preferably 0.2 μm or less and the single or plural samples or wafers are cooled at a temperature of 20 K or less. Preferably, sets of the buffer have an active vibration reducing function.

In the present invention, the vacuum vessel is preferably provided with an optical window which is detachable or can open or close so that the single or plural samples or wafers can be observed or optically measured through the optical window. The optical window can be opened for replacing the single or plural samples or wafers. In addition, the thermal radiation shield is provided with an opening or a thermal blocking optical window with a cover which is detachable or can open or close so that optical measurement can be carried out through the opening or the thermal blocking optical window. Furthermore, the vacuum vessel preferably includes means for connecting or accessing an electric wire, a probe electrode, cantilever or optical probe member to the single or plural samples or wafers. The vacuum vessel is secured to a cylindrical or rod shaped thermal insulator at least by two or more beams, which penetrate the thermal radiation shield. The beams are in the shape of a bolt and are inserted in holes formed in the vacuum vessel from the outside of the vacuum vessel and fixed to the thermal insulator. The head of the beams in the shape of a bolt are covered with vacuum covers closely attached to the vacuum vessel and sealed by O-rings between the vacuum covers and the vacuum vessel so as to prevent a vacuum leakage. Alternatively, cylindrical side surface of the beams is attached to side surface of the holes formed in the vacuum vessel and sealed with O-rings between the cylindrical side surface of the beams and the side surface of the holes. In order to adjust the position or tilt of the single or plural samples or wafers with respect to the measurement reference surface, six to eight beams are preferably used in the present invention.

In the present invention, when a sample or wafer is fixed to the sample holder, a ring or mesh-shaped plate is disposed on the sample or wafer, which is, in turn, fixed to the sample holder with screws or cramps. The sample holder preferably has an electrostatic adsorption function. The flexible thermal conduction member is made of any materials selected from copper wire, silver wire, silver-plated copper wire, gold-plated copper wire, gold-plated silver wire, copper ribbon, silver ribbon, silver-plated copper ribbon, gold-plated copper ribbon, and gold-plated silver ribbon.

In the present invention, a gate valve and a load lock are preferably disposed for replacing a sample or wafer on the sample holder in the vacuum vessel. A cassette containing a single or plural samples or wafers may be provided within or outside the load lock for transferring the single or plural samples or wafers. The sample or wafer may be exchanged by a manual arm or automatic arm. An optical table is preferably used as a table for forming the measurement reference surface or the optical table may be fixed to the table for forming the measurement reference surface, where the optical table or the table is a part forming the housing. In an embodiment of the present invention, the measurement reference surface can be moved or finely adjusted to a second measurement reference surface. A GM-type refrigerating machine, Solvay-type refrigerating machine, Joule-Thomson-type refrigerating machine, piston pipe type refrigerating machine, or helium circulating type refrigerating machine can be used in the present invention. The present invention is preferably used for microscopic observation, microspectroscopic analysis, near-field microscopic observation, near-field spectroscopic analysis, optical response characteristic evaluation, photoconduction characteristic evaluation, or conduction characteristic evaluation of samples or wafers.

According to the present invention, even when samples or wafers are cooled at a cryogenic temperature, vibration or drift of the samples or wafers with respect to a measurement reference surface can be substantially removed. For example, with samples or wafers at a temperature of 20 K or less, vibration or drift can be suppressed to be 0.2 μm or less. Therefore, the samples or wafers can be subjected to precision microscopic observation, microspectroscopic analysis, near-field microscopic observation, near-field spectroscopic analysis, optical response characteristic evaluation, photoconduction characteristic evaluation, or conduction characteristic evaluation at the cryogenic temperature or higher temperatures, where precision microscopic observation or microspectroscopic analysis may be carried out with scanning tunneling microscope (STM), atomic force microscope (AFM), near-field scanning optical microscope (NSOM) or other various kinds of scanning probe microscope (SPM).

BRIEF DESCRIPTION OF THE DRAWINGS

This and other objects, features, and advantages of the present invention will become more apparent upon reading of the following detailed description and drawings in which.

DESCRIPTION OF THE EMBODIMENTS

An embodiment of a sample cooling apparatus according to the present invention will be explained below by referring the drawings.

Figure 1:
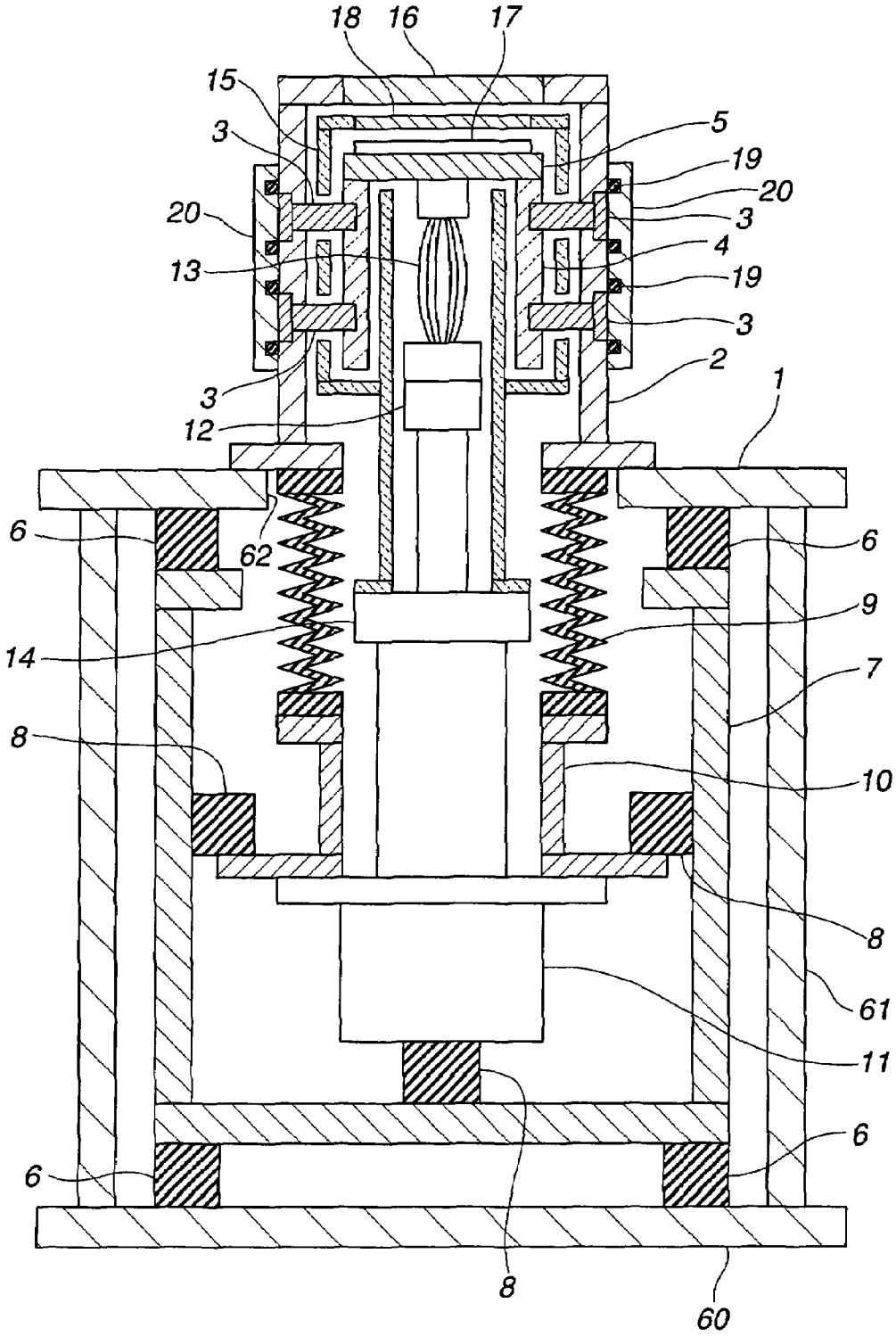
FIG. 1 is a diagrammatic view, partly in vertical section and partly in side elevation, of a structure of a sample cooling apparatus according to the present invention.

FIG. 1 is a diagrammatic view, partly in vertical section and partly in side elevation, of a structure of a sample cooling apparatus according to the present invention. As shown in FIG. 1, the sample cooling apparatus includes a vacuum vessel 2 mounted on a housing having a table for forming a measurement reference surface 1 in which a sample holder 5 is disposed to be supported by a thermal insulator 4. Within the housing, a frame 7 is disposed to be supported by first buffers 6, and a refrigerating machine 11 is supported by the frame 7 by means of second buffers 8, while a head of the refrigerating machine 12 is directed to the vacuum vessel 2. The head 12 of the refrigerating machine 11 is connected to the sample holder 5 by means of a flexible thermal conduction member 13.

The table for forming the measurement reference surface 1 includes a horizontal flat upper surface supported by a vertical wall 61 extending from a bottom plate 60. The table for measurement reference surface 1 has a hole 62 at the center thereof. In the sample cooling apparatus shown in FIG. 1, the vacuum vessel 2, which has a U-shaped cross section and a lower opening, is disposed above the flat measurement reference surface 1 of the table, and the frame 7, which has an upper opening and a U-shaped cross section, is disposed below the table for measurement reference surface 1 to support the refrigerating machine 11 by means of the second buffers 8. In FIG. 1 the housing is composed of the table for forming the measurement reference surface 1, the vertical wall 61, and the bottom plate 60.

The head 12 of the refrigerating machine 11 is directed to the vacuum vessel 2 and the lower portion of the head 12 is disposed within a space in the frame 7, and hermetically surrounded by a sealing wall 10, an upper end of which is connected to a lower portion of the vacuum vessel 2 by means of a flexible vacuum bellows 9 to form a vacuum chamber communicating with a space within the vacuum vessel 2. In FIG. 1, an intermediate cooling portion 14 of the refrigerating machine 11 is disposed in the vacuum chamber.

The refrigerating machine 11 is supported by the frame 7 by means of the second buffers 8 which are disposed between the sealing wall 10 and an inner wall of the frame 7, and on a bottom wall of the frame 7.

The thermal insulator 4 is connected to the lower circumference of the horizontally arranged sample holder 5, and supported by the beams 3 extending from the vacuum vessel 2. The head 12 of the refrigerating machine 11 is directed to the open bottom space defined by the sample holder 5 and the thermal insulator 4. A thermal radiation shield 15 extending upward from the intermediate cooling portion 14 of the refrigerating machine 11 is disposed for covering the flexible thermal conduction member 13, the thermal insulator 4 and the sample holder 5 in FIG. 1.

As explained hereinabove, in the sample cooling apparatus of the present invention, the refrigerating machine 11 is disposed within the frame 7 and the vacuum vessel 2 is mounted on the measurement reference surface 1 of the table. As a result, the sample cooling apparatus can be smaller in size and an assembly work, maintenance, or replacement of the sample in the sample cooling apparatus can be facilitated.

In an alternate embodiment of the present invention, the vacuum vessel 2 may be disposed below the measurement reference surface so as to arrange other measuring devices on the upper space of the measurement reference surface 1.

The refrigerating machine 11 and the sealing wall 10 vibrate when the refrigerating machine 11 is operated. However, the buffers 8 disposed between the refrigerating machine 11 and the sealing wall 10 and on the frame 7 can attenuate the vibration, and thus the reduced vibration propagates a little to the frame 7. It is to be understood that the frame 7 is suspended with respect to the measurement reference surface by the first buffers 6 such that the frame 7 can vibrate independently, and is connected to the refrigerating machine 11 and the sealing wall 10 by the second buffers 8. Thus, the frame 7 vibrates with a time lag behind the vibration of the refrigerating machine 11 and the sealing wall 10. In other words, the vibration of the frame 7 becomes out of phase with respect to the vibration of the refrigerating machine 11 and the sealing wall 10 so as to cancel the vibration of the refrigerating machine 11 and the sealing wall 10.

The first buffers 6 further attenuate feeble vibrations propagating to the frame 7. As a result, the vibration of the refrigerating machine 11 and the sealing wall 10 does not substantially propagate to the measurement reference surface 1 or the devices or members mounted on the measurement reference surface 1. Furthermore, the vibration originated from the refrigerating machine 11 and the sealing wall 10 can be suppressed. The attenuated vibration of the refrigerating machine 11 and the sealing wall 10 is less propagated to the measurement reference surface 1 due to the flexibility of the flexible vacuum bellows 9.

The head 12 of the refrigerating machine 11 cools the sample holder 5 and the sample 17 by means of the flexible thermal conduction member 13. Due to the flexibility of the flexible thermal conduction member 13, the attenuated vibration of the refrigerating machine 11 is less transferred toward the sample holder 5 and the sample 17. According to the present invention, the vibration or drift of the sample 17 with respect to the measurement reference surface 1 can be prevented even when the sample 17 is cooled at a cryogenic temperature.

In the present invention, if the first buffer 6 or the second buffer 8 has an active vibration reducing function, the sample 17 can be subjected to no vibration or no drift state with respect to the measurement reference surface 1. The active vibration reducing function means that an original vibration is cancelled in a feedback mode by detecting the original vibration and generating another vibration having the same amplitude as that of the original vibration and a phase opposite to that of the original vibration to permit total vibration to be less than the original vibration.

According to the present invention, the vacuum vessel 2 is provided with an optical window 16, which allows the sample 17 to be observed or effects optical measurements, and a thermal insulating optical window 18 attached to the thermal radiation shield 15 prevents the temperature rise of the sample 17, even if the sample 17 is observed from the outside. Furthermore, means for connecting or accessing electric wires, external probe electrodes, cantilevers, or optical probe members to the sample 17 may be provided. The thermal radiation shield 15 can increase the thermal radiation shielding effect, if it is disposed inside or outside the thermal insulator 4 as shown in FIG. 1. The thermal insulator 4 and the vacuum vessel 2 are connected by at least two or more beams 3 penetrating the thermal radiation shield 15 so that the sample 17 is firmly positioned with respect to the measurement reference surface 1 to reduce the relative movement of the sample 17 and the measurement reference surface 1. The beam has the shape of a bolt and is inserted from outside the vacuum vessel 2 to fix the thermal insulator 4. The head of the beam 3 is covered with a vacuum cover 20 sealed to the vacuum vessel 2 by means of O-rings 19 so that the sample 17 can be firmly fixed to the measurement reference surface 1, and maintain the vacuum vessel 2 or vacuum chamber in vacuum.

A fine adjustment of the positions of the thermal insulator 4, the sample holder 5, and the sample 17 is possible by adjusting fastening degree of the beams 3. It is to be understood that means for moving or fine adjusting these elements with respect to the measurement reference surface 1 may be provided. The O-rings may be disposed beneath the head of the beam 3 around the cylindrical side surface thereof. The position or tilt of the thermal insulator 4, the sample holder 5, and the sample 17 with respect to the measurement reference surface 1 can be adjusted with much precision, if six to eight beams are used.

The thermal insulator 4 in a cylindrical or rod shape increases its mechanical strength and can securely fix the sample holder 5 and the sample 17 to the measurement reference surface 1. The sample 17 may be fixed on the sample holder 5 with an adhesive agent. However, a ring or mesh plate (not shown) may be placed over the sample 17 and screwed or cramped to the sample holder 5 so that the attachment or replacement of the sample may be facilitated. Alternatively, the sample 17 is fixed to a separate plate (not shown), which is, in turn, attached or detached to the sample holder 5. The sample holder 5 having an electrostatic adsorption function more facilitates attachment or detachment of the sample 17.

The flexible thermal conduction member 13 is made of any materials selected from a copper wire, silver wire, silver-plated copper wire, gold-plated copper wire, gold-plated silver wire, copper ribbon, silver ribbon, silver-plated copper ribbon, gold plated copper ribbon, or gold-plated silver ribbon. A gate valve (not shown) and load lock (not shown) may be disposed to change the sample 17 in the vacuum vessel 2 so that the sample 17 may be exchanged while the vacuum degree in the vacuum vessel 2 or the vacuum chamber is maintained. In this instance, if a cassette for holding a single or plural samples or wafers is provided in the inside or outside of the load lock for exchanging the sample or wafer, the plural samples or wafers can be measured continuously. The exchange of the sample or wafer can be done more quickly if a manual or automatic arm is used. Alternatively, the sample or wafer is fixed to a separate plate and replaced together with the separate plate.

In the present invention, if the table for forming the measurement reference surface 1 is made of an optical table, it is possible to measure the sample 17 using an optical measuring system installed on the optical table. The refrigerating machine, the frame, the vacuum vessel, and other members may be arranged laterally or arranged upside down to the measurement reference surface 1 or the optical table. In an alternative embodiment of the present invention, the sample cooling apparatus is provided with means for moving or finely adjusting the measurement reference surface 1 with respect to a second measurement reference surface. According to this embodiment, surface distribution measurements of a certain physical value on/in the sample 17 can be done using systems installed on the second measurement reference surface.

The refrigerating machine 11 used in the present invention may be the GM-type refrigerating machine, Solvey-type refrigerating machine, Joule/Thomson type refrigerating machine, piston pipe type refrigerating machine, or helium circulating type refrigerating machine.

The sample cooling apparatus of the present invention can be utilized for microscopic observation, microspectroscopic analysis, near-field microscopic observation, near-field spectroscopic analysis, optical response characteristic evaluation, photoconduction characteristic evaluation or conduction characteristic evaluation of the sample 17 or the sample 17 in the form of wafer.

Figure 2:
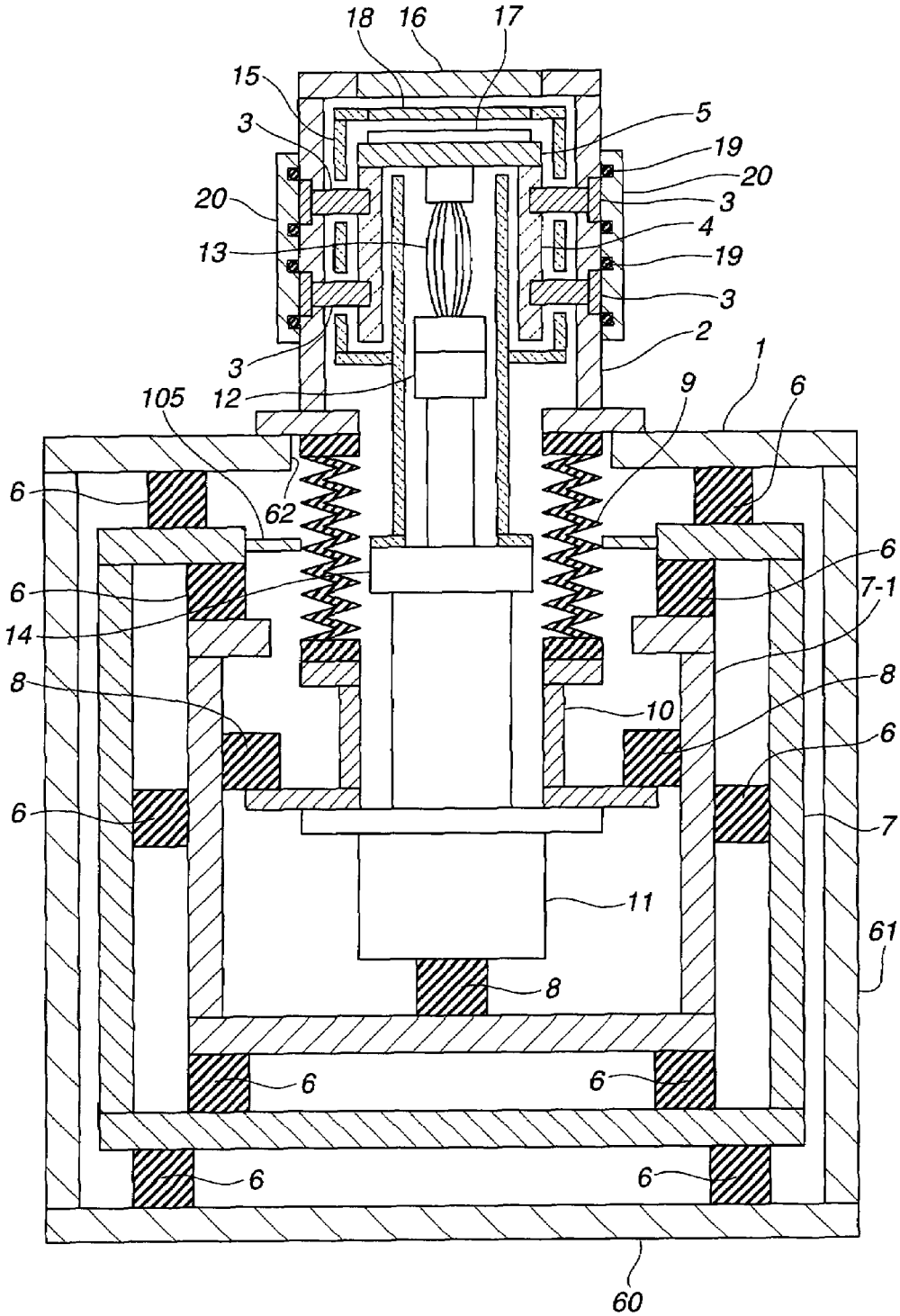
FIG. 2 illustrates a modification of the sample cooling apparatus shown in FIG. 1.

FIG. 2 illustrates a modification of the sample cooling apparatus shown in FIG. 1. The sample cooling apparatus shown in FIG. 2 is similar to that disclosed in FIG. 1. In FIG. 2, the frame has a dual or two-stage structure containing an inner frame 7-1 within the outer frame 7, each of which is independently supported by multiple buffers. This structure makes it possible to significantly diminish the propagation of the vibration. It is to be understood that the frame may have a triple or multiple stage structure to further diminish the propagation of the vibration. In addition, the flexible vacuum bellows 9 may be supported by a beam 105 formed on the frame 7 so as to enhance the vibration removal effect.

Figure 3:
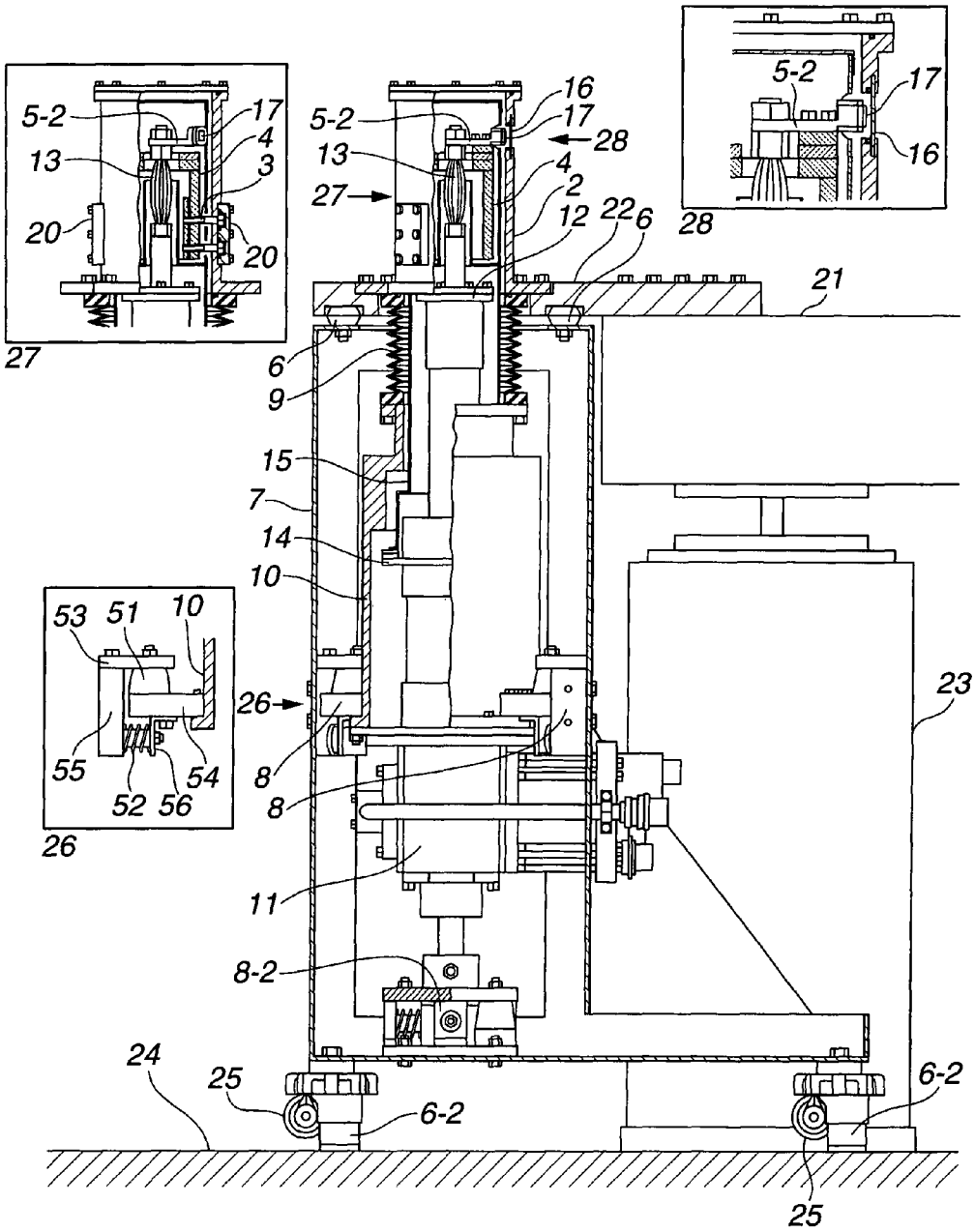
FIG. 3 is a plan view, partly in section, of a sample cooling apparatus according to a first embodiment of the present invention.

FIG. 3 shows a sample cooling apparatus according to a first embodiment of the present invention. The sample cooling apparatus according to the first embodiment of the present invention includes a base plate 22 which is fixed to a optical table 21 for forming a reference measuring surface 1 on which a vacuum vessel 2, beams 3, a thermal insulator 4, a sample holder 5-2, first buffers 6 and 6-2, a frame 7, second buffers 8 and 8-2, flexible vacuum bellows 9, a sealing wall 10, a refrigerating machine 11, a flexible thermal conduction member 13, and a thermal radiation shield 15 are firmly mounted in the same manner as the sample cooling apparatus shown in FIG. 1.

In the first embodiment of the present invention, the measurement reference surface 1 is formed on the optical table 21. A vacuum vessel 2 is firmly attached to the base plate 22, which is securely fixed to the optical table 21. The optical table 21 is supported on a floor 24 by means of a column 23. The sample cooling apparatus is provided with frame 7 which is supported by first buffers 6 to be connected to the base plate 22 or supported by first buffers 6-2 to be connected to the floor 24. The optical table 21 or the column 23 may have another vibration reducing function. In FIG. 3 the housing is composed of the optical table 21, the base plate 22, the column 23 and the floor 24.

A refrigerating machine 11 and a sealing wall 10 are arranged within the frame 7 to be supported by the second buffers 8 and 8-2. The sealing wall 10 is connected to the vacuum vessel 2 by means of the flexible vacuum bellows 9. This structure makes it possible to reduce the overall size of the sample cooling apparatus. The first buffer 6 is made of a buffer member, such as, for example, a rubber, resin, gel or spring. The second buffers 8 and 8-2 are formed of a combination of buffer members, which are disposed so as to lessen or absorb the vibrations in each spatial direction. The second buffer 8 comprises a buffer member 51 which lessens the vertical vibration and a spring buffer 52 which lessens the horizontal vibration, and is supported by support members 53, 54, 55, and 56. The second buffer 8-2 assembles the four functions of the second buffer 8. The combination of buffer member is not limited to the example as explained hereinabove. Obviously, other combination is possible.

A sample holder 5-2 is securely mounted on the thermal insulator 4 attached to the vacuum vessel 2 by means of the beams 3. The lower portion of the sample holder 5-2 is connected to a head 12 of the refrigerating machine 11 by means of the flexible thermal conduction member 13. A thermal radiation shield 15 extends from an intermediate cooling portion 14 of the refrigerating machine 11, and covers the head 12 of the refrigerating machine 11, the flexible thermal conduction member 13 and the sample holder 5-2 to intercept the thermal radiation from the outside.

In the first embodiment of the present invention, the sample 17 on the sample holder 5-2 is placed penetrating the thermal radiation shield 15 so that the sample 17 can be observed more near from the optical window 16 on the side of the vacuum vessel 2. The sample cooling apparatus of the first embodiment of the present invention can cool the sample 17 below a temperature of 10 K. The vibration or drift of the sample 17 can be suppressed below 0.1 μm with respect to the optical table 21 or base plate 22 defining the measurement reference surface. If casters 25 are attached to the frame 7, the sample cooling apparatus can be moved easily.

Figure 4:
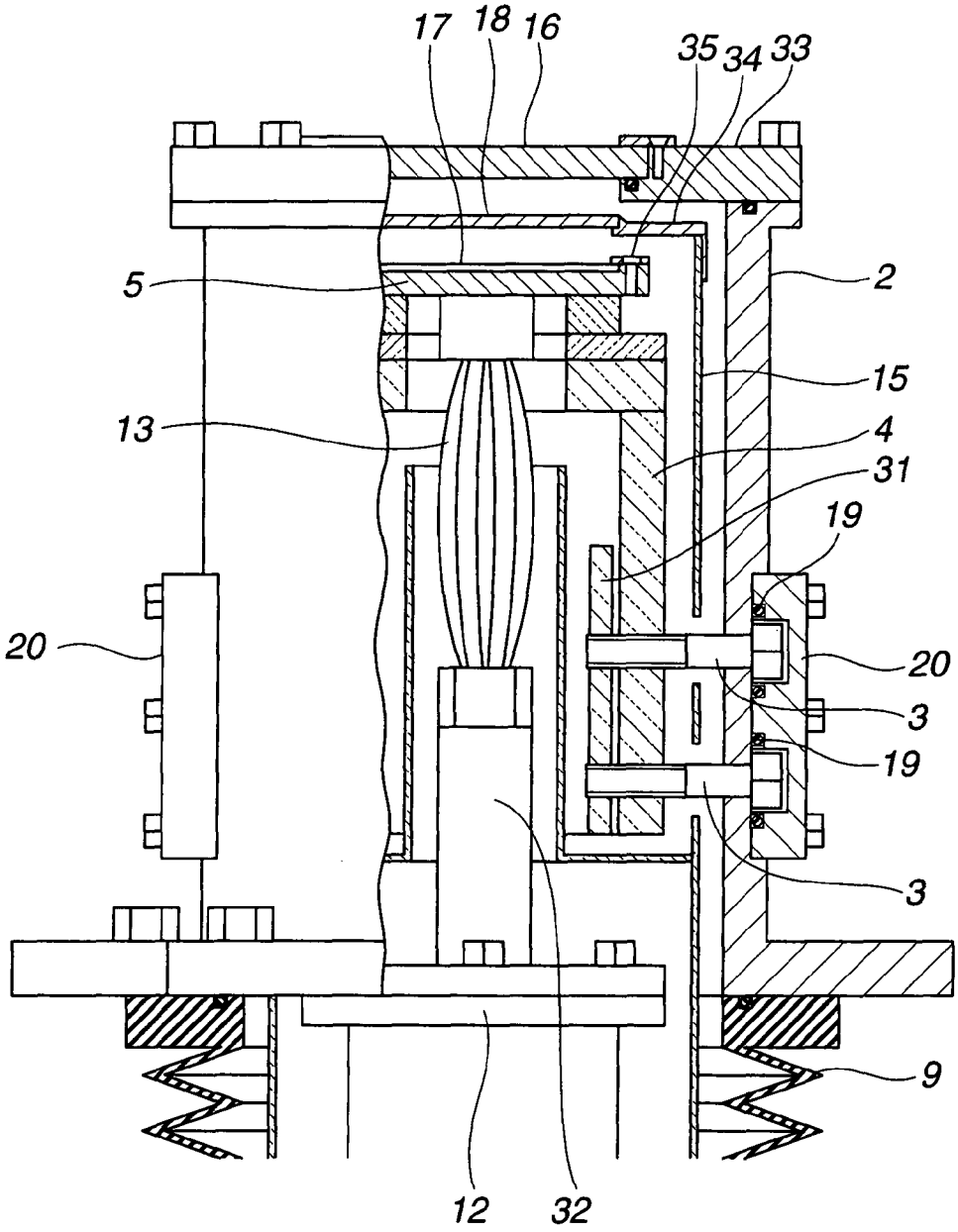
FIG. 4 is a partial plan view, partly in section, of a sample cooling apparatus according to a second embodiment of the present invention.

FIG. 4 shows a sample cooling apparatus according to a second embodiment of the present invention. The second embodiment is constructed so that a sample can be observed from above. According to the second embodiment of the present invention, the sample 17 can be replaced by opening both a thermal radiation shield cover 34 with a thermal insulating optical window 18 and a vacuum vessel cover 33, and unfixing a fixing ring 35. In this embodiment, the beams 3 are inserted from the outside of the vacuum vessel 2 and are screwed to a stopper 31 located inside the thermal insulator 4 passing through holes formed in the thermal radiation shield 15. The flexible thermal conduction member 13 is connected to the head 12 of the refrigerating machine 11 by means of a thermal conduction member 32. Both ends of the flexible thermal conduction member 13 are provided with connectors for connecting the sample holder 5 and the thermal conduction member 32, respectively. The sample 17 in a wafer state can be firmly placed on the sample holder 5 using the fixing ring 35. However, the sample can be exchanged more easily, if the sample holder 5 has an electrostatic adsorption function. The sample 17 may be mounted on a separate plate (not shown), and exchanged together with the separate plate.

Figure 5:
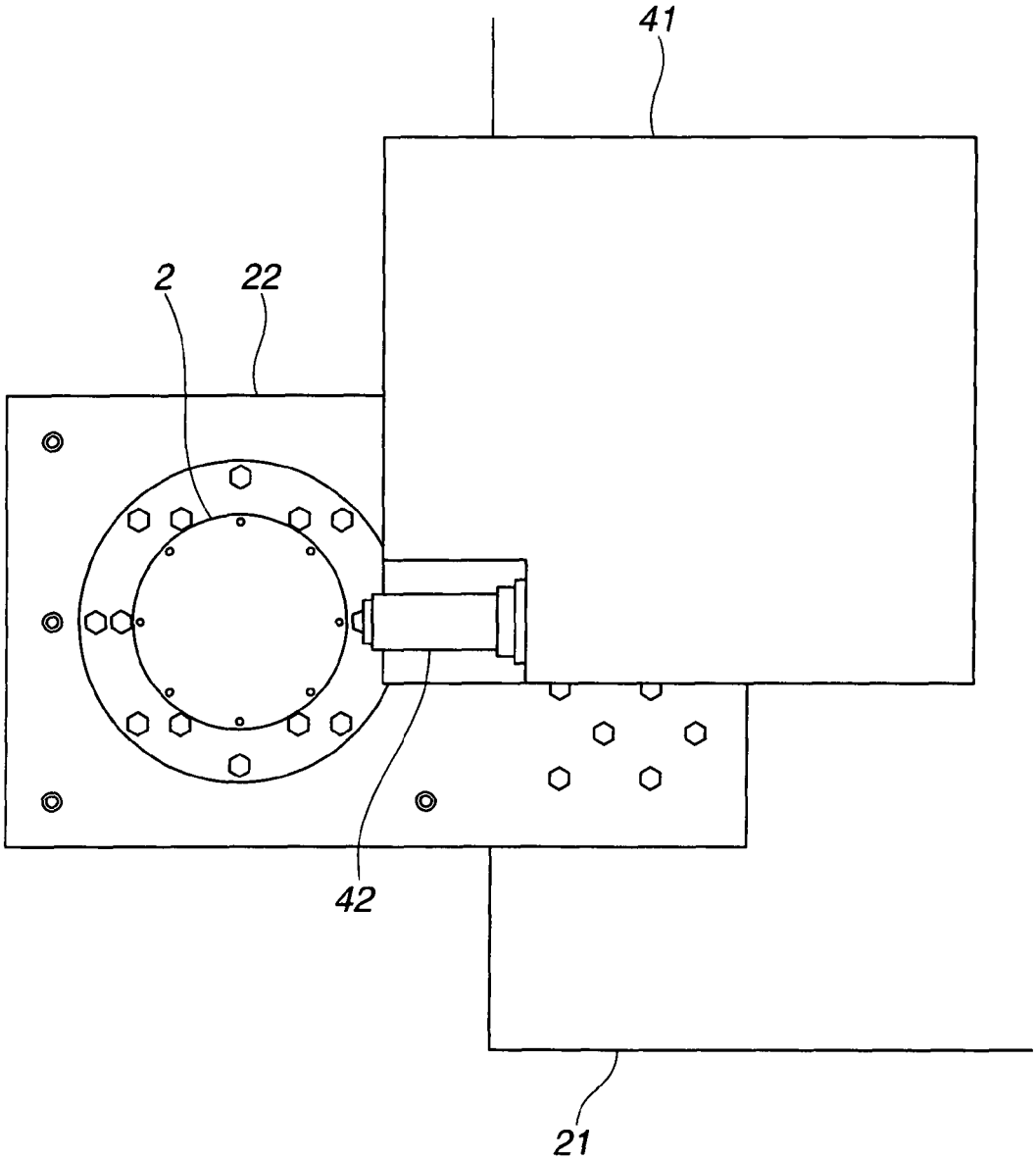
FIG. 5 is a top plan view of a sample cooling apparatus according to a third embodiment of the present invention.

FIG. 5 shows a sample cooling apparatus according to a third embodiment of the present invention. In the third embodiment of the present invention, a sample can be observed or can be subjected to microspectroscopic analysis or microscopic optical response measurement from the side of the vacuum vessel by means of an objective lens 42 attached to a microscopic spectroscope 41. The measurement reference surface is defined on the optical table 21, and the sample cooling apparatus of the present invention and the microscopic spectroscope are fixed to the optical table 21. According to the third embodiment, a high precision microscopic observation, microspectroscopic analysis, or microscopic optical response measurement can be performed under the vibration or drift of a sample suppressed to be 0.1 μm or less with respect to the optical table 21 and at the sample temperature of 10 K or less.

Figure 6:
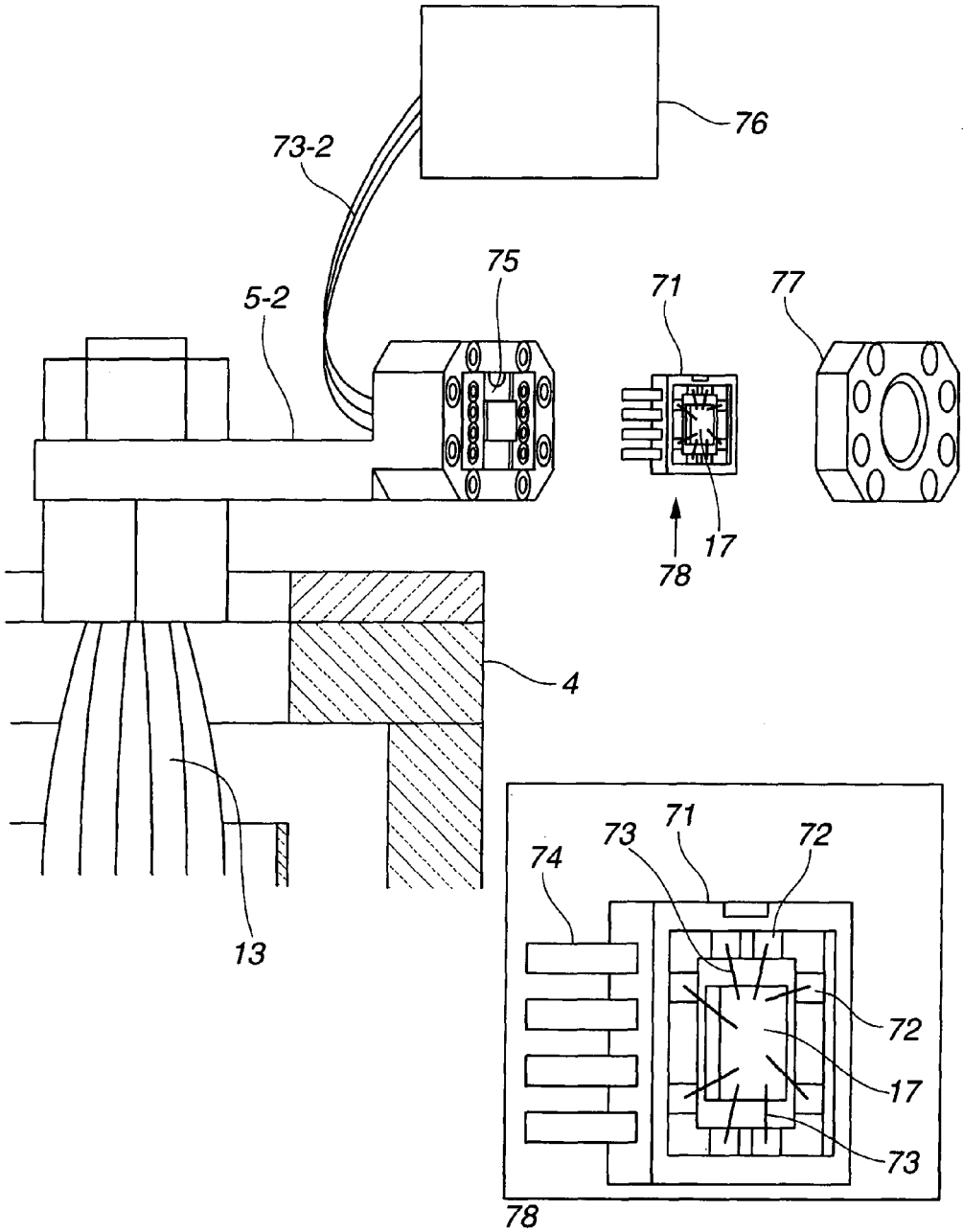
FIG. 6 is a diagrammatic view of a sample cooling apparatus according to a fourth embodiment of the present invention.

FIG. 6 shows a sample cooling apparatus according to a fourth embodiment of the present invention. According to the fourth embodiment of the present invention, an optical conduction characteristic or conduction characteristic of a sample can be measured. In this embodiment, the sample 17 is pasted on an IC package 71, and is electrically connected to the electrode pads 72 in the IC package 71 with electric wires 73. Electrode leads 74 of the IC package 71 are plugged in an IC socket 75 mounted on the sample holder 5-2. A set of electric wires 73-2 is connected to each electrode leads of the IC socket 75 to connect the sample 17 and an electric measuring device 76 electrically. In this arrangement, the optical conduction characteristics and conduction characteristics of the sample 17 can be measured. A sample cover 77 may be placed on the IC package 71 to stabilize a temperature of the sample 17. Obviously, the set of electric wires can be connected to the sample without using the IC package and the IC socket, although it is somewhat uneasy to use.

Figure 7:
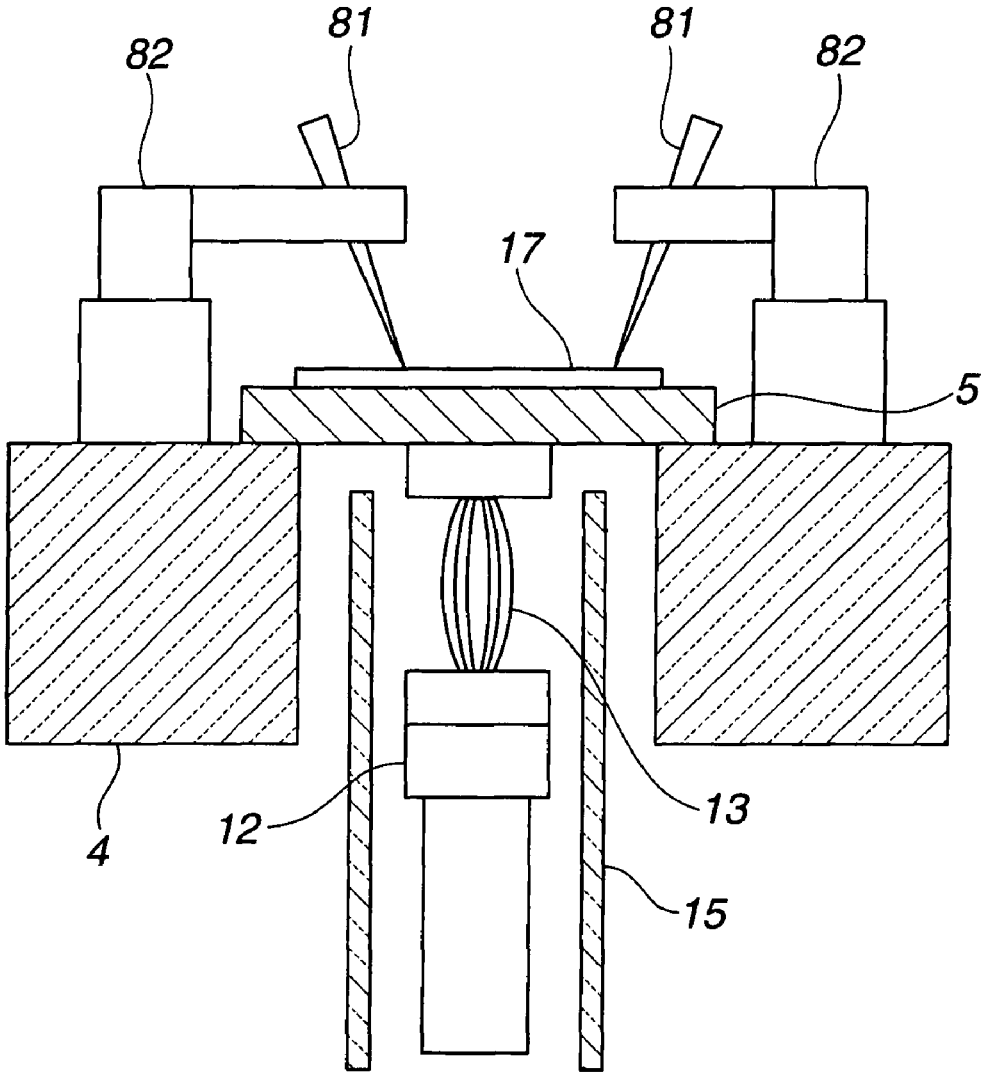
FIG. 7 is a diagrammatic sectional side elevation view of a sample cooling apparatus according to a fifth embodiment of the present invention.

FIG. 7 shows a sample cooling apparatus according to a fifth embodiment of the present invention. The fifth embodiment is another example of measuring the optical conduction characteristics or conduction characteristics of a sample. In this embodiment, the sample 17 placed on the sample holder 5 is electrically connected to an electric measuring device by probe electrodes 81, which permits plural electric paths of the sample 17 to measure electrically by moving the probe electrodes 81 with the moving stage 82. It is to be understood that the near-field microscopic observation or near-field spectral analysis can be performed by using the probe electrode 81 or a cantilever or optical probe in place of the probe electrode 81.

Figure 8:
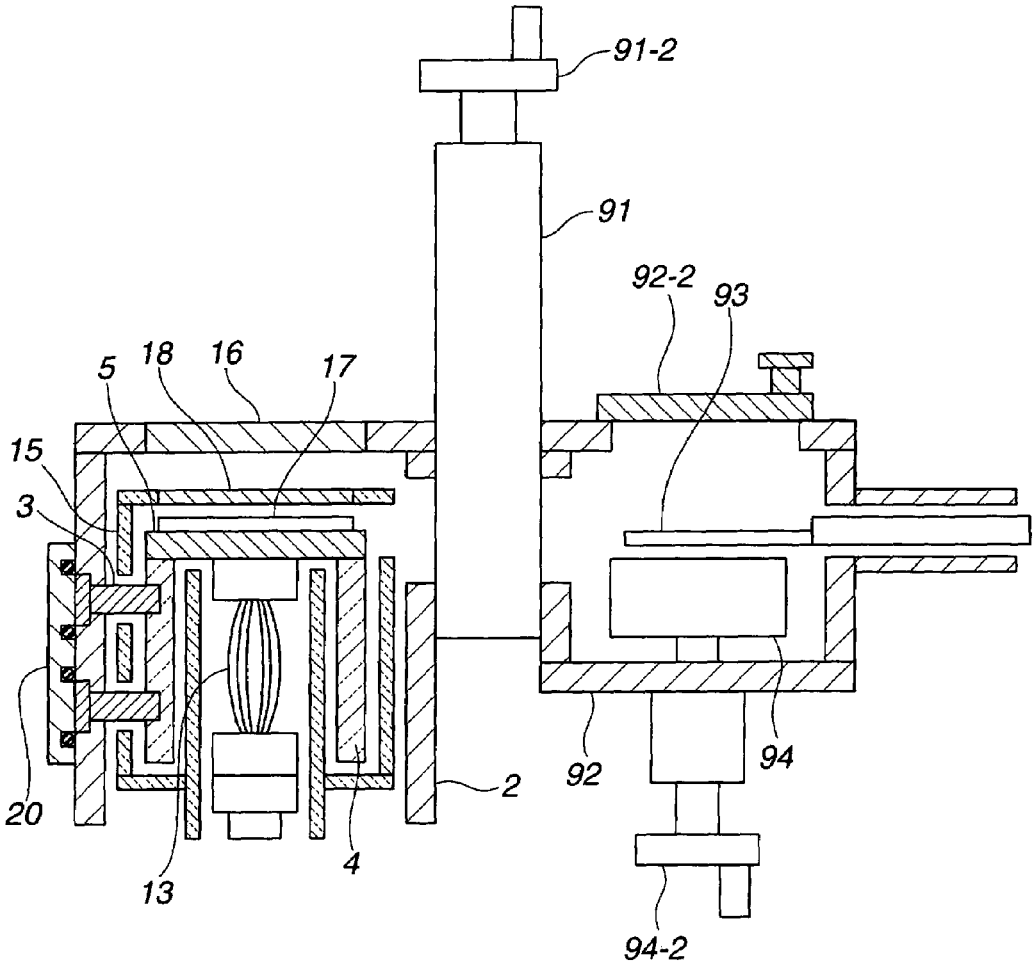
FIG. 8 is a partial plan view, partly in section, of a sample cooling apparatus according to a sixth embodiment of the present invention.

FIG. 8 shows a sample cooling apparatus according to a sixth embodiment of the present invention. The sixth embodiment is an example to facilitate an exchange of a sample or wafer. In the sixth embodiment, a gate valve 91 and a load lock 92 are mounted to the vacuum vessel 2. The sample 17 can be moved from the vacuum vessel 2 to the load lock 92 or from the load lock 92 to the sample holder 5 in the vacuum vessel 2 by opening the gate valve 91 by means of the gate valve opening/closing mechanism 91-2, while the vacuum state is maintained in the vacuum vessel 2 and in the load lock 92, and getting the arm 93 into and out of the vacuum vessel 2. In this instance, the sample can be exchanged with the sample holder 5 maintained at a low temperature, or the vacuum vessel 2 or vacuum chamber and load rock 92 are maintained in vacuum. As a result, the measuring time can be shortened. The arm 93 may be operated manually. The sample can be exchanged accurately and quickly, if an automatic arm is used.

If a cassette 94 for holding a single or plural samples or wafers for replacement is arranged in the load lock 92, plural samples or wafers can be continuously measured while the vacuum state is maintained. The cassette 94 can be moved by a cassette moving mechanism 94-2, and the sample or wafers or cassette 94 can be taken out by opening the load lock door 92-2. The cassette 94 may be placed in the vacuum vessel 2. In this case, the cassette moving mechanism 94-2 is disposed in the vacuum vessel 2. If the sample holder 5 includes a sample holding mechanism or an electrostatic adsorption function, the attachment and detachment of the sample 17 and the cooling efficiency of the sample cooling apparatus are significantly improved. The sample may be fixed to a separate plate (not shown) and the separate plate may be attached to or detached from the sample holder 5.

Figure 9:
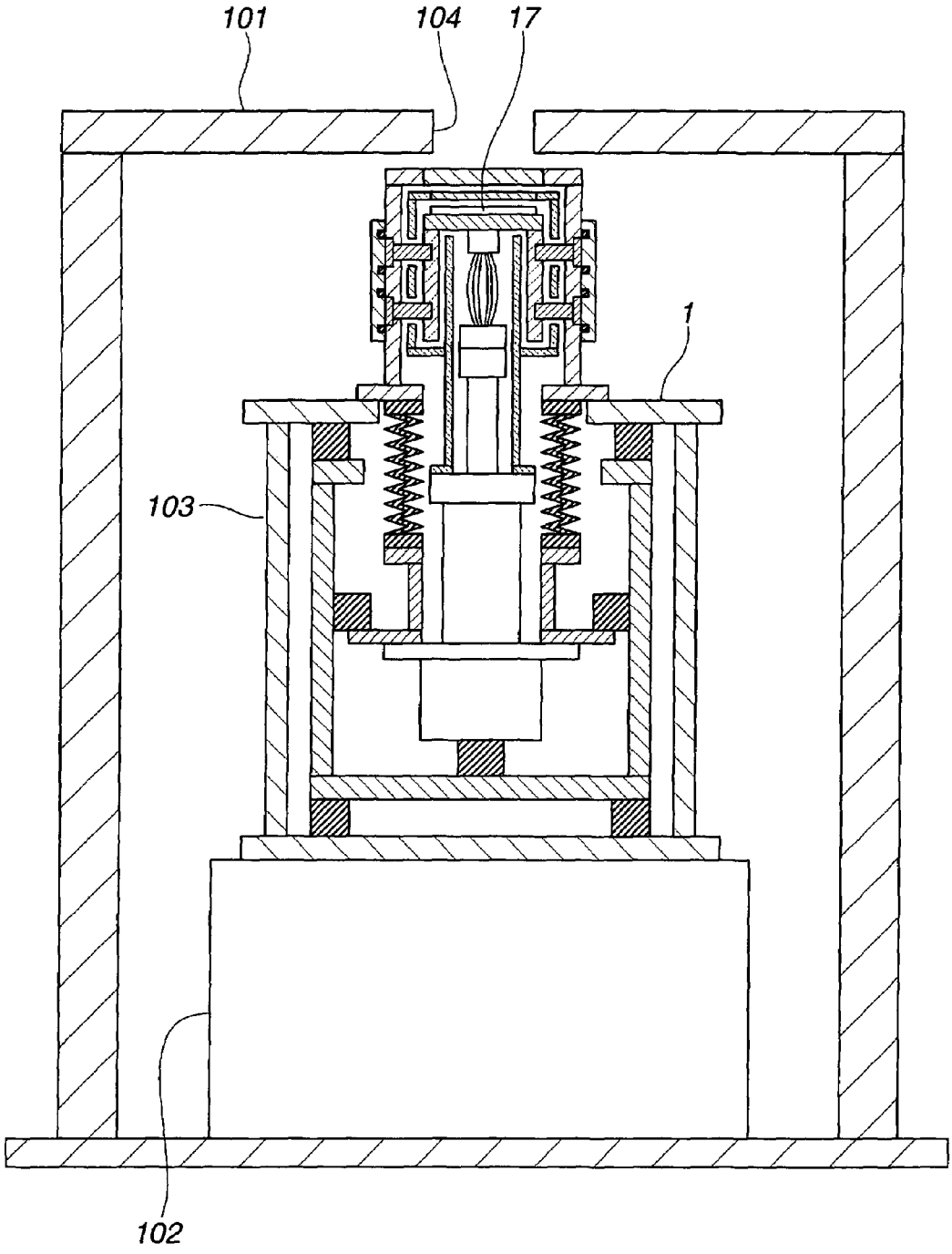
FIG. 9 is a sectional side elevation view of a sample cooling apparatus according to a seventh embodiment of the present invention.

FIG. 9 shows a sample cooling apparatus according to a seventh embodiment of the present invention. In the seventh embodiment, the apparatus is provided with means for traveling or finely adjusting the measurement reference surface 1 or the sample 17 with respect to a second measurement reference surface 101. The sample cooling apparatus 103 is installed on a moving stage 102 that can change the relative position of the sample cooling apparatus 103 or the measurement reference surface 1 or the sample 17 with respect to the second measurement reference surface 101. In this embodiment, an optical measuring system is mounted on the second measurement reference surface 101, and an in-plane distribution characteristics of the sample 17 is measured through a hole 104 by sliding the sample cooling apparatus 103 or the measurement reference surface 1 or the sample 17 by means of the moving stage 102.

As explained hereinabove, when samples or wafers are cooled at a cryogenic temperature with a conventional refrigerating machine, vibrations of the refrigerating machine as a vibration source propagate to the samples or wafers to make the samples or wafers to vibrate or drift with respect to a measurement reference surface. The vibrations deteriorate the degree of precision of microscopic observation, microspectroscopic analysis, near-field microscopic observation, near-field spectroscopic analysis, optical conduction characteristic evaluation, or conduction characteristic evaluation. According to the present invention, the measurement of samples or wafers at a cryogenic temperature can be done with high precision. Thus, the present invention is useful to carry out microscopic observation, microspectroscopic analysis, microscopic optical conduction characteristic measurement, near-field microscopic observation, or near-field spectroscopic analysis of samples or wafers at a cryogenic temperature. When the sample cooling apparatus of the present invention is applied as a wafer inspection apparatus, a high-resolution measurement at a cryogenic temperature can be done easily, and a quality control of the wafer can be performed with a high reliability.

A best form of a sample cooling apparatus of the present invention has been explained according to embodiments. However, the present invention should not be limited only to the proposed embodiments. Various other embodiments will be considered within the scope of technical matters defined in the attached claims.

What is claimed is:

1. A sample cooling apparatus comprising:

a sample holder arranged in and fixed on a vacuum vessel supported by a thermal insulator, said vacuum vessel being mounted and fixed on a table forming a measurement reference surface, with the table being disposed on a housing;

a frame disposed within said housing, said frame being supported by a first deformable buffer member arranged between said housing and said frame; and a refrigerating machine disposed within said frame, said refrigerating machine being supported by a second deformable buffer member arranged between said frame and said refrigerating machine and having a head of said refrigerating machine directed to and disposed in said vacuum vessel; said head of said refrigerating machine being connected to said sample holder by way of a flexible thermal conduction member arranged between said sample holder and said head of said refrigerating machine; said vacuum vessel being mounted on said refrigerating machine through a flexible vacuum bellows arranged between said vacuum vessel and said refrigerating machine, wherein said first and second deformable buffer members each exhibit a buffering function by deformation of said deformable buffer members;

said frame is disposed between said housing and said refrigerating machine, and is suspended in the air via said first deformable buffer member and second deformable buffer member; and said frame vibrates or moves independently between said housing and said refrigerating machine, by virtue of said deformation of said first and second deformable buffer members.

2. The sample cooling apparatus as defined in claim 1, wherein said vacuum vessel is disposed on one side of said measurement reference surface and said frame is disposed on the other side of said measurement reference surface.

3. The sample cooling apparatus as defined in claim 1, wherein said housing is provided with said vacuum vessel disposed above a hole formed in said table, said vacuum vessel being open-bottomed and U-shaped in cross section and said frame disposed below said hole formed in said table, said frame being open-topped and U-shaped in cross section;

wherein said refrigerating machine is disposed for having a head of said refrigerating machine directed to said vacuum vessel and a lower portion against said head of said refrigerating machine positioned in said frame, a side portion of said refrigerating machine being enclosed by a sealing wall, the sealing wall being disposed within the frame and supported by the second deformable buffer member; and wherein an upper portion of said sealing wall and a lower portion of said vacuum vessel are connected with the flexible vacuum bellows.

4. The sample cooling apparatus as defined in claim 1, wherein said sample holder, said flexible thermal conduction member, and said head of said refrigerating machine are covered with a thermal radiation shield connected to an intermediate cooling portion of said refrigerating machine.

5. The sample cooling apparatus as defined in claim 4, wherein said thermal radiation shield is provided with an optical measurement opening.

6. The sample cooling apparatus as defined in claim 4, wherein said thermal radiation shield is provided with a detachable or opening/closing cover.

7. The sample cooling apparatus as defined in claim 4, wherein said thermal radiation shield is provided with a thermal blocking optical window.

8. The sample cooling apparatus as defined in claim 1, further comprising:

a sample or a wafer mounted on said sample holder, wherein vibration and drift values of said sample or said wafer is 0.2 μm or less, respectively, and a temperature of said sample or said wafer is 20 K or less.

9. The sample cooling apparatus as defined in claim 5, further comprising means for connecting or approaching an electric wire, probe electrode, cantilever or optical probe to said sample or said wafer.

10. The sample cooling apparatus as defined in claim 5, wherein said sample or said wafer is mounted on said sample holder by means of a ring or mesh shaped plate, said plate being placed on said sample or said wafer and securely fixed to said sample holder with one or more screws or one or more clamps.

11. The sample cooling apparatus as defined in claim 5, further comprising a gate valve and a load lock for replacing said sample or said wafer in said vacuum vessel.

12. The sample cooling apparatus as defined in claim 11, further comprising a cassette for exchanging said sample or said wafer, said cassette being disposed within or outside said load lock and holding a single or plural samples or wafers.

13. The sample cooling apparatus as defined in claim 5, further comprising a manual arm or an automatic arm for replacing said sample or said wafer.

14. The sample cooling apparatus as defined in claim 1, wherein said first deformable buffer member and said second deformable buffer member each have an active vibration reducing function.

15. The sample cooling apparatus as defined in claim 1, wherein said vacuum vessel is provided with a detachable or opening/closing optical window.

16. The sample cooling apparatus as defined in claim 1, wherein said thermal insulator is fixed to said vacuum vessel by at least two beams or more.

17. The sample cooling apparatus as defined in claim 12, wherein said beams penetrate said thermal radiation shield.

18. The sample cooling apparatus as defined in claim 12, wherein said beams are in a shape of a bolt and are inserted in holes formed in said vacuum vessel from outside of said vacuum vessel for fixing said thermal insulator; and wherein a head of said bolt is covered with a vacuum cover attached to said vacuum vessel and sealed with O-rings arranged between said vacuum cover and said vacuum vessel.

19. The sample cooling apparatus as defined in claim 12, wherein said beams have a cylindrical side surface, said cylindrical side surface being attached to side surface of said holes formed in said vacuum vessel and sealed with O-rings between said cylindrical side surface of said beams and said side surface of said holes.

20. The sample cooling apparatus as defined in claim 1, further comprising means for adjusting position or tilt of said sample holder with respect to said measurement reference surface by means of six to eight beams.

21. The sample cooling apparatus as defined in claim 1, wherein said thermal insulator is of a cylindrical or rod shape.

22. The sample cooling apparatus as defined in claim 1, wherein said sample holder has an electrostatic adsorption function.

23. The sample cooling apparatus as defined in claim 1, wherein said flexible thermal conduction member is made of one or more material selected from a group consisting of a copper wire, silver wire, silver-plated copper wire, gold-plated copper wire, gold-plated silver wire, copper ribbon, silver ribbon, silver-plated copper ribbon, gold-plated copper ribbon, and gold-plated silver ribbon.

24. The sample cooling apparatus as defined in claim 1, wherein said table for forming said measurement reference surface is an optical table.

25. The sample cooling apparatus as defined in claim 1, further comprising means for moving said measurement reference surface with respect to a second measurement reference surface.

26. The sample cooling apparatus as defined in claim 1, wherein said refrigerating machine is selected from a group consisting of a GM-type refrigerating machine, Solvay-type refrigerating machine, Joule-Thomson-type refrigerating machine, piston pipe type refrigerating machine, or helium circulating type refrigerating machine.

27. The sample cooling apparatus for use in microscopic observation, microspectroscopic analysis, near-field microscopic observation, near-field spectroscopic analysis, optical response characteristic evaluation, photoconduction characteristic evaluation, or conduction characteristic evaluation of a sample or wafer as defined in claim 1.

28. A sample cooling apparatus comprising:

a refrigerating machine having a head;

a vacuum vessel;

a sample holder;

a thermal insulator;

a flexible thermal conduction member;

a flexible vacuum bellows;

a frame;

a housing having a member for forming a measurement reference surface;

a first deformable buffer member; and a second deformable buffer member, wherein said head of said refrigerating machine is disposed in said vacuum vessel, said vacuum vessel is fixed on said member for forming a measurement reference surface, said sample holder is fixed on said vacuum vessel via said thermal insulator, and is further connected to said head of said refrigerating machine via said flexible thermal conduction member, said flexible vacuum bellows is arranged between said vacuum vessel and said refrigerating machine, said first deformable buffer member is arranged between said housing and said frame, said second deformable buffer member is arranged between said frame and said refrigerating machine, said first and second deformable buffer members each exhibit a buffering function by deformation thereof;

said frame is disposed between said housing and said refrigerating machine, and is suspended in the air via said first deformable buffer member and second deformable buffer member; and said frame vibrates or moves independently between said housing and said refrigerating machine, by virtue of said deformation of said first and second deformable buffer members.

29. The sample cooling apparatus according to claim 28, wherein the first and second deformable buffer members are formed from one or more of rubber, resin, gel, and spring.

30. The sample cooling apparatus according to claim 28, wherein said housing is provided with said vacuum vessel disposed above a hole formed in said table, said vacuum vessel being open-bottomed and U-shaped in cross section and said frame disposed below said hole formed in said table, said frame being open-topped and U-shaped in cross section;

said refrigerating machine is disposed having a head of said refrigerating machine directed to said vacuum vessel and a lower portion against said head of said refrigerating machine positioned in said frame, a side portion of said refrigerating machine being enclosed by a sealing wall, the sealing wall being disposed within the frame and supported by the second deformable buffer member; and an upper portion of said sealing wall and a lower portion of said vacuum vessel are connected with the flexible vacuum bellows.

31. A sample cooling apparatus comprising:

a refrigerating machine having a head;

a vacuum vessel;

a sample holder;

a thermal insulator;

a flexible thermal conduction member;

a flexible vacuum bellows;

a frame;

a housing having a member for forming a measurement reference surface;

a first deformable buffer member; and a second deformable buffer member, wherein said head of said refrigerating machine is disposed in said vacuum vessel, said vacuum vessel is fixed on said member for forming a measurement reference surface, said sample holder is fixed on said vacuum vessel via said thermal insulator, and is further connected to said head of said refrigerating machine via said flexible thermal conduction member, said flexible vacuum bellows is arranged between said vacuum vessel and said refrigerating machine, said first deformable buffer member is arranged between said housing and said frame, said second deformable buffer member is arranged between said frame and said refrigerating machine, said first deformable buffer member and said deformable second deformable buffer member each have an active vibration reducing function, said first and second deformable buffer members each exhibit a buffering function by deformation thereof;

said frame is disposed between said housing and said refrigerating machine, and is suspended in the air via said first deformable buffer member and second deformable buffer member; and said frame vibrates or moves independently between said housing and said refrigerating machine, by virtue of said deformation of said first and second deformable buffer members.

* * * * *